US009498102B2

(12) United States Patent
Chae et al.

(10) Patent No.: US 9,498,102 B2
(45) Date of Patent: Nov. 22, 2016

(54) DISHWASHER WITH TENSION ADJUSTMENT SYSTEM

(71) Applicant: SAMSUNG ELECTRONICS CO., LTD., Suwon-si, Gyeonggi-do (KR)

(72) Inventors: Seung Min Chae, Suwon-si (KR); Young Su Ser, Hwaseong-si (KR); Sung Jin Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/528,628

(22) Filed: Oct. 30, 2014

(65) Prior Publication Data

US 2015/0182101 A1 Jul. 2, 2015

(30) Foreign Application Priority Data

Dec. 31, 2013 (KR) ..... 10-2013-0168944
Mar. 20, 2014 (KR) ..... 10-2014-0032855

(51) Int. Cl.

| | |
|---|---|
| ***A47B 95/02*** | (2006.01) |
| ***A47L 15/42*** | (2006.01) |
| ***E05F 1/10*** | (2006.01) |
| ***E05D 7/00*** | (2006.01) |

(52) U.S. Cl.

CPC ..... *A47L 15/4261* (2013.01); *E05D 7/00* (2013.01); *E05F 1/10* (2013.01); *Y10T 16/5386* (2015.01)

(58) Field of Classification Search

CPC ..... A47L 15/4261; E05F 1/10; E05F 3/18; E05D 7/00; E05D 13/1207; F24C 15/023; Y10T 16/5386

See application file for complete search history.

(56) References Cited

U.S. PATENT DOCUMENTS 3,046,974 A * 7/1962 Kimberley ..... F24C 15/023 126/191
3,067,736 A * 12/1962 Barefoot ..... F24C 15/023 126/194
3,820,866 A * 6/1974 Kaldenberg ..... A47L 5/4261 312/276
4,021,968 A * 5/1977 Kendall ..... E05F 1/1075 126/191
5,980,006 A * 11/1999 Wilhelmstatter ... A47L 15/4261 126/191

(Continued)

FOREIGN PATENT DOCUMENTS

DE 3618740 A1 * 12/1987 ..... A47L 15/4261
DE 42 30 410 A1 3/1994

(Continued)

OTHER PUBLICATIONS

European Search Report issued May 4, 2015 in corresponding European Patent Application No. 14191562.9.

*Primary Examiner* — Hanh V Tran
(74) *Attorney, Agent, or Firm* — Staas & Halsey LLP

(57) ABSTRACT

A dishwasher in which a user conveniently adjusts tension of a spring according to various materials or weights of a cover coupled to a door. The dishwasher includes a housing, a door rotatably mounted to a front surface of the housing, door hinges mounted to both sides of a lower portion of the door and rotatably coupled to the housing, springs connected to the door hinges and arranged at both side portions inside the housing, a wire to connect the springs, a shaft configured to rotate and having one end portion exposed outside the housing, a first rotation member connected to the other end portion of the shaft and formed with a worm, and a second rotation member engaged with the worm and connected to the wire. Tension of the springs is simultaneously adjusted by changing a length of the wire by rotation of the shaft.

18 Claims, 10 Drawing Sheets

(56) References Cited

U.S. PATENT DOCUMENTS 5,988,933 A * 11/1999 Wilhelmstatter ... A47L 15/4261 126/191
6,761,204 B1 * 7/2004 Chou ..... E06B 9/322 160/177 R
7,699,064 B2 * 4/2010 Schlief ..... A47L 15/4261 134/104.4
8,292,381 B2 * 10/2012 McDaniel ..... A47L 15/4261 312/319.2
8,297,768 B2 * 10/2012 Kara ..... A47L 15/4246 134/113
8,944,530 B2 * 2/2015 Haft ..... E05D 13/1207 312/228
2003/0042825 A1 * 3/2003 Welch ..... A47L 15/504 312/228.1
2008/0272678 A1 * 11/2008 Tynes ..... A47L 15/4261 312/319.4
2009/0072686 A1 * 3/2009 Vooren ..... A47L 15/4261 312/319.4
2010/0051067 A1 * 3/2010 Dalsing ..... A47L 15/4261 134/46
2010/0127606 A1 * 5/2010 Collene ..... E05F 1/1292 312/327
2011/0074261 A1 * 3/2011 Assmann ..... A47L 15/4259 312/326
2011/0187246 A1 * 8/2011 Shin ..... A47L 15/4261 312/228
2011/0215691 A1 * 9/2011 Keskin ..... A47L 15/4261 312/319.2
2011/0241507 A1 * 10/2011 Diebold ..... A47L 15/4261 312/228
2011/0266932 A1 * 11/2011 Numanoglu ..... A47L 15/4265 312/204
2011/0316401 A1 * 12/2011 Cummins ..... E05F 1/1066 312/319.2
2013/0232877 A1 * 9/2013 Tiekoetter ..... E05F 15/70 49/138

FOREIGN PATENT DOCUMENTS

EP 2 556 782 A1 2/2013
IT GB 2219623 A * 12/1989 ..... A47L 15/4261
TR EP 2147627 A1 * 1/2010 ..... A47L 15/4261
WO WO 2006/137039 A2 12/2006
WO WO 2006/137039 A3 12/2006
WO WO 2009/146874 A1 12/2009

* cited by examiner

DISHWASHER WITH TENSION ADJUSTMENT SYSTEM

CROSS-REFERENCE TO RELATED APPLICATIONS

This application claims the priority benefit of Korean Patent Application Nos. 10-2013-0168944 and 10-2014-0032855, filed on Dec. 31, 2013 and Mar. 20, 2014, respectively, in the Korean Intellectual Property Office, the disclosures of each of which are incorporated herein by reference.

BACKGROUND

1. Field

Example embodiments of the present disclosure relate to a dishwasher in which a door is easily opened and closed.

2. Description of the Related Art

In general, a dishwasher is an apparatus to easily clean and sanitize tableware, and includes a wash water pump to spray wash water stored in a sump through spray nozzles. Wash water sprayed through spray nozzles is ejected with high pressure, and splashes on a surface of tableware placed on a tableware rack. Therefore, by the pressure of wash water splashed on the surface of tableware, dirt remaining on the surface of tableware is removed.

A door of a dishwasher is rotatably installed to a housing of the dishwasher using a hinge member. The bottom of the door is assembled to the hinge member in such a manner that one end of a spring fixed to the housing is connected to the hinge member to pull the door.

Therefore, as a user pulls a door using a doorknob, the door is opened by pulling force. While the door is completely open, the weight of the door surpasses restoring force of a spring and thus the door remains open.

Lately, however, a so-called built-in type of dishwasher is being used, as the built-in dishwasher is installed into cabinetry in order to increase space efficiency while offering a sense of monolithic beauty at the same time.

In addition, in the case of a built-in dishwasher being installed, a cover having the same design and color as cabinetry is coupled to a front door of the built-in dishwasher in order to give a sense of monolithic beauty.

However, if a cover is coupled to a door, depending on a material and weight of the cover, the weight of the door coupled with the cover changes, and therefore, tension of a spring which controls rotation of the door needs to be adjusted.

SUMMARY

It is an aspect of the present disclosure to provide a dishwasher in which a user or a service technician can conveniently adjust tension of a spring according to various materials or weights of a cover coupled to a door.

It is another aspect of the present disclosure to provide a dishwasher in which left and right deviations of a door are minimized by uniformly adjusting left and right balance of the door.

It is a further aspect of the present disclosure to provide a dishwasher with increased convenience in installation by adjusting tension of a spring without disassembling a cover.

It is a still further aspect of the present disclosure to provide a dishwasher in which a moving door is stopped at a predetermined angle.

Additional aspects of the disclosure will be set forth in part in the description which follows and, in part, will be obvious from the description, or may be learned by practice of the invention.

In accordance with one aspect of the present disclosure, there is provided a dishwasher including: a housing; a door rotatably mounted to a front surface of the housing; door hinges mounted to both sides of a lower portion of the door and rotatably coupled to the housing; springs connected to the door hinges and arranged in a forward and backward direction at both side portions inside the housing in order to adjust movement of the door; a wire to connect the springs; a shaft configured to rotate and having one end portion which is exposed outside the housing; a first rotation member connected to the other end portion of the shaft and formed with a worm on an outer peripheral surface thereof; and a second rotation member engaged with the worm and connected to the wire, wherein tension of the springs is simultaneously adjusted by changing a length of the wire by rotation of the shaft.

The second rotation member may include a body, a gear part formed at an end portion of the body to be engaged with the worm, and a wire fixing part formed on an outer peripheral surface of the body, on which the wire is wound.

The gear part may include a helical gear.

The wire fixing part may include a wire insertion recess into which the wire is inserted to be connected thereto.

The wire insertion recess may include any one of a cross-shaped recess and a straight-shaped recess formed at a portion of the body.

The housing may be formed with a tension adjustment hole through which external force is applied to the shaft to rotate the same.

The tension adjustment hole may be formed at a lower portion of any one of a front panel and a rear panel of the housing.

The shaft may be provided with a rotation support part at an end portion thereof. The rotation support part may have a rotation support recess to which a rotation tool is coupled through the tension adjustment hole.

Each of the door hinges may include a hinge bracket coupled to the lower portion of the door and a rope having one end portion connected to the hinge bracket and the other end portion connected to each of the springs.

Each of the door hinges may further include a support bracket provided at the housing and a guide roller mounted to the support bracket to guide movement of the rope.

The housing may include one or more wire guide rollers to guide movement of the wire.

The support bracket may include a stopper unit configured to contact the hinge bracket, by which the door is kept opened at a constant angle.

The stopper unit may include a stopper body configured to rotate about a rotation shaft in order to restrict rotation of the hinge bracket and a torsion spring to apply elastic force to the stopper body.

In accordance with another aspect of the present disclosure, there is provided a dishwasher including: a door rotatably mounted to a front surface of a housing; door hinges mounted to both sides of a lower portion of the door; a first spring connected to one of the door hinges and arranged in a width direction at one side portion of the housing in order to adjust rotation of the door; a second spring connected to the other of the door hinges and arranged in a width direction at the other side portion of the housing in order to adjust rotation of the door; a connection member to connect the first spring and the second spring; a shaft to adjust elastic force of the first spring and the second spring by changing a length of the connection member, the shaft being configured to rotate and having one end portion which is exposed outside the housing; a first rotation member connected to the other end portion of the shaft and formed with a worm on an outer peripheral surface thereof; and a second rotation member including a helical gear engaged with the worm to rotate therewith and a wire fixing part on which the connection member is wound to be connected thereto.

The wire fixing part may include a wire insertion recess into which the connection member is inserted to be connected thereto.

The housing may be formed with a tension adjustment hole through which external force is applied to the shaft to rotate the same.

The tension adjustment hole may be formed at a lower portion of any one of a front panel and a rear panel of the housing.

Each of the door hinges may include a hinge bracket coupled to the lower portion of the door and a rope having one end portion connected to the hinge bracket and the other end portion connected to each of the first and second springs.

Each of the door hinges may further include a support bracket provided at the housing and a guide roller mounted to the support bracket to guide movement of the rope.

The housing may include one or more wire guide rollers to guide movement of the connection member.

The support bracket may include a stopper unit configured to contact the hinge bracket, by which the door is kept opened at a constant angle.

The stopper unit may include a stopper body configured to rotate about a rotation shaft in order to restrict rotation of the hinge bracket and an elastic part to apply elastic force to the stopper body.

The stopper body may include an arc-shaped front surface so as to return to an original position by elastic force of the elastic part when the door is opened and closed.

In accordance with another aspect of the present disclosure, there is provided a tension adjustment system for a door rotatably mounted to a housing, including: door hinges mounted to both sides of a lower portion of the door; a first spring connected to one of the door hinges; a second spring connected to the other of the door hinges; a connection member to connect the first spring and the second spring; a shaft to adjust elastic force of the first spring and the second spring by changing a length of the connection member, the shaft being configured to rotate; a first rotation member connected to an end portion of the shaft; and a second rotation member engaged with the first rotation member to rotate therewith and a wire fixing part on which the connection member is wound to be connected thereto, wherein the changing of the length of the connection member adjusts rotation of the door.

The tensions of the first spring and the second spring may be simultaneously adjusted by changing the length of the connection member by rotation of the shaft.

As is apparent from the above description, a consumer or a technician can easily and uniformly adjust left and right balance of the door according to various materials and weights of a cover and ornaments attached to the door, thereby minimizing left and right deviations of the door.

In addition, since a consumer or a technician can adjust tension of the spring without disassembling a cover, convenience in installation and use may be enhanced.

In addition, since a moving door is stopped at a predetermined angle, sudden falling of the door may be prevented, and accordingly, deformation of the door or surrounding components may be prevented. As a result, quality and durability of the dishwasher and door may be improved.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
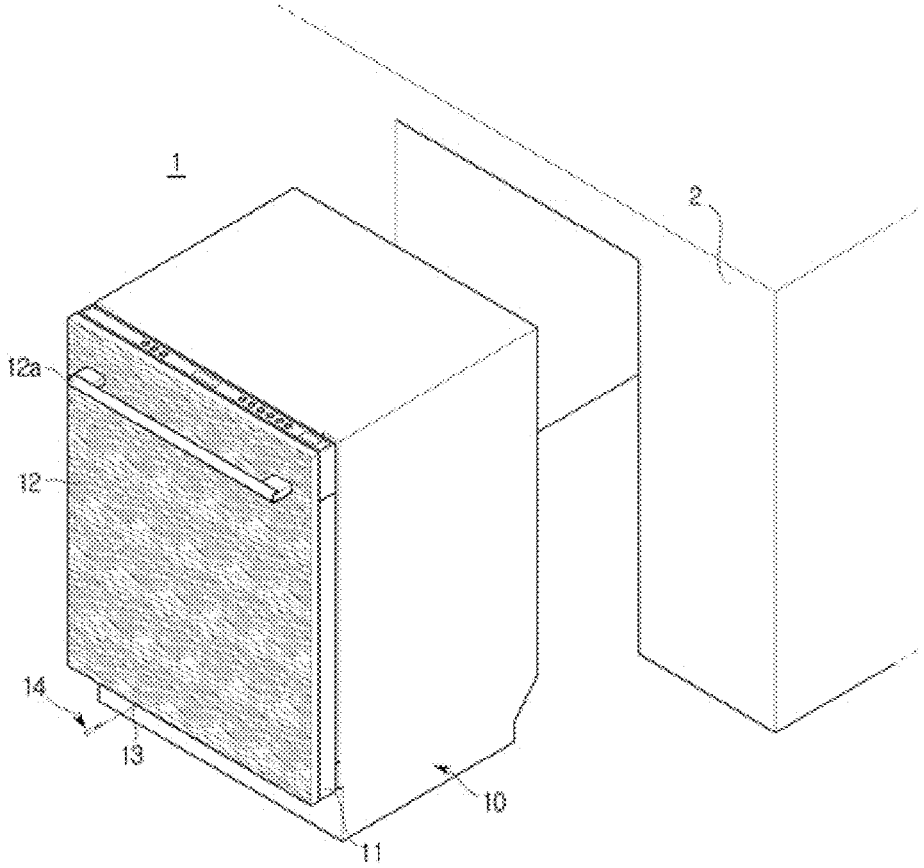
FIG. 1 is a view schematically illustrating a dishwasher according to an exemplary embodiment of the present disclosure.

Reference will now be made in detail to the embodiments of the present disclosure, examples of which are illustrated in the accompanying drawings, wherein like reference numerals refer to like elements throughout.

Figure 2:
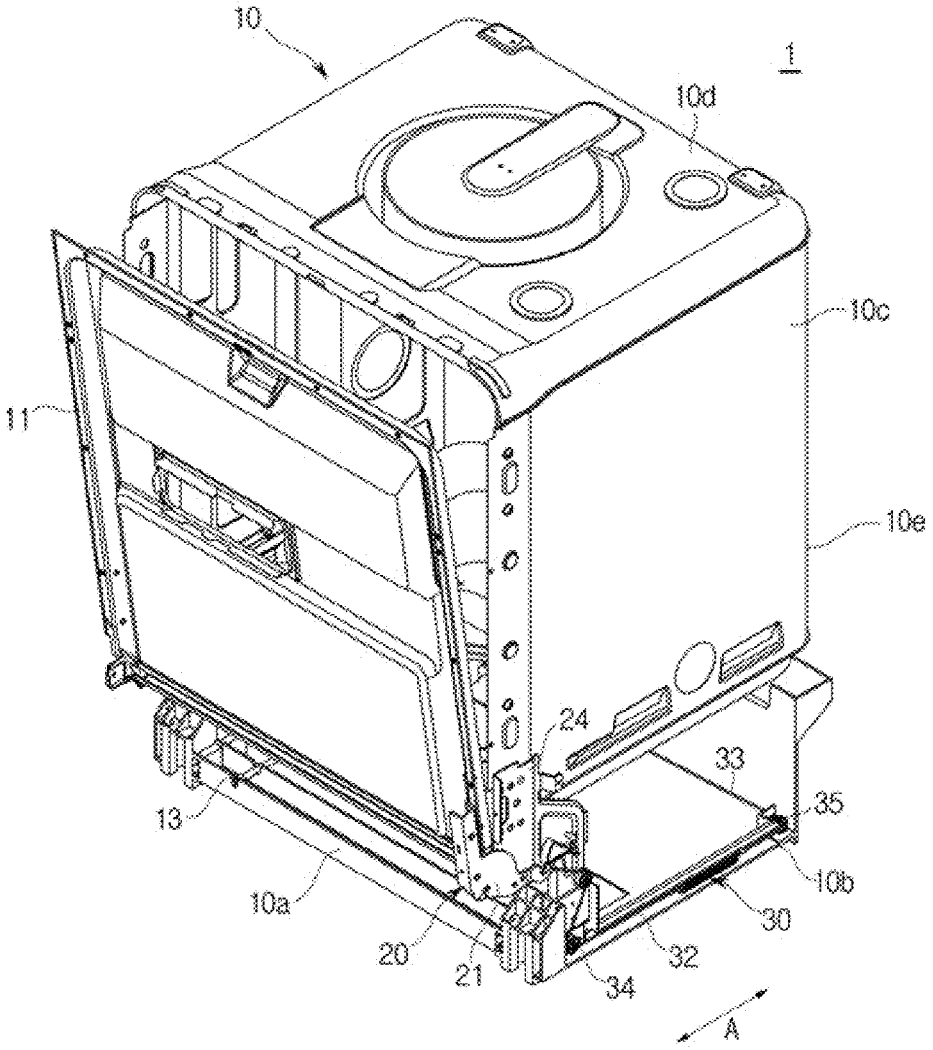
FIG. 2 is a perspective view schematically illustrating a hinge door and a tension adjustment unit of the dishwasher according to an exemplary embodiment of the present disclosure.
Figure 3:
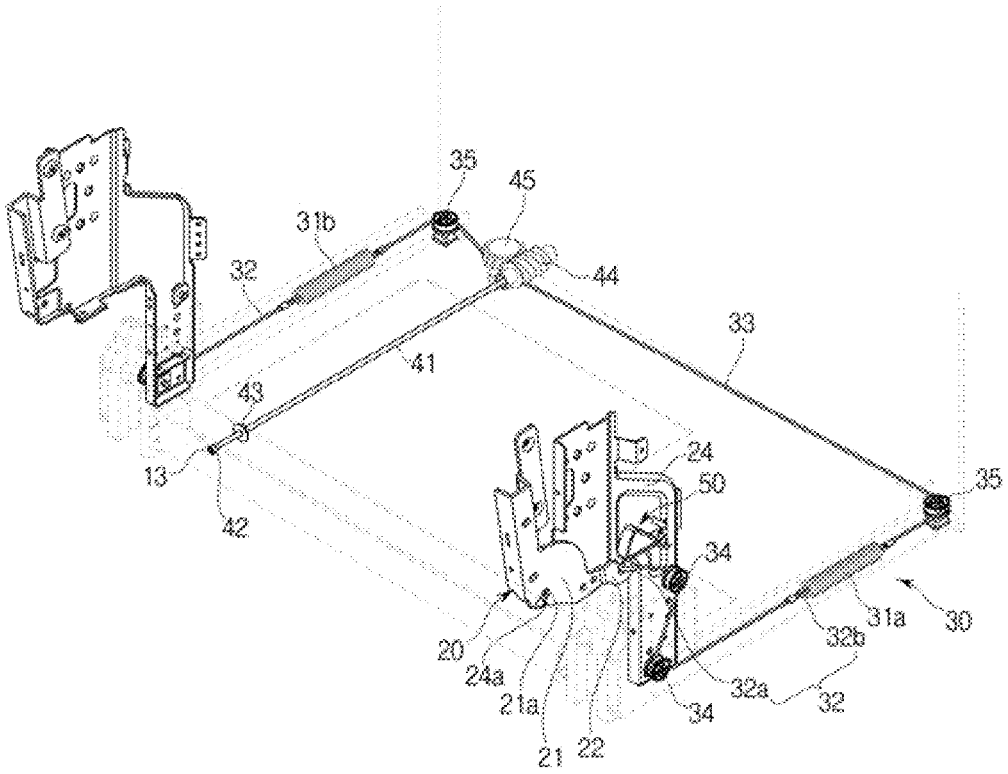
FIG. 3 is a perspective view schematically illustrating the tension adjustment unit of the dishwasher according to an exemplary embodiment of the present disclosure.
Figure 4:
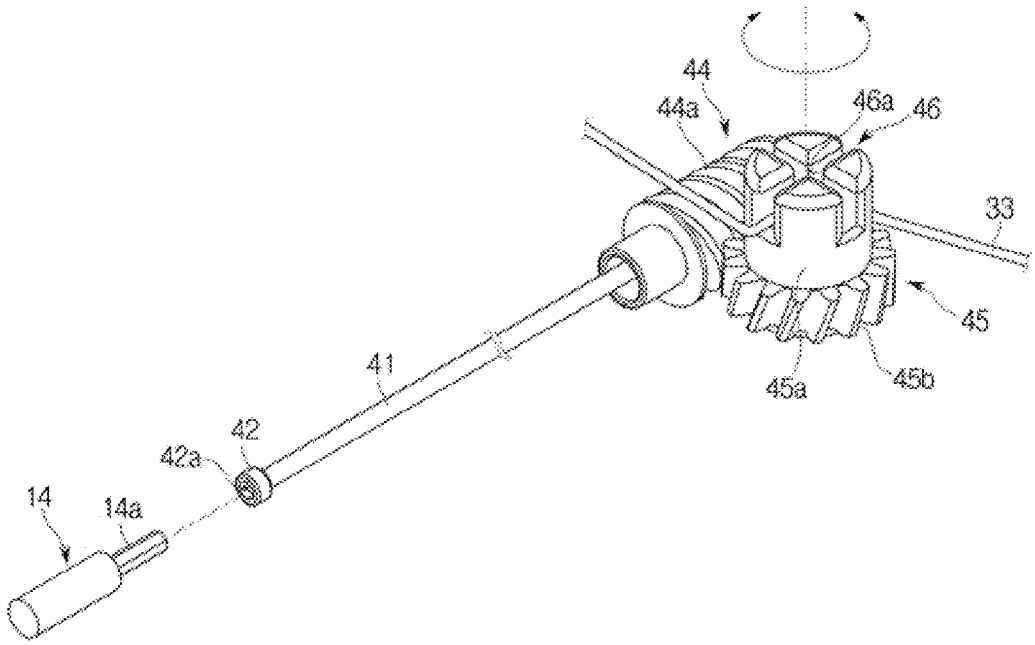
FIG. 4 is a view schematically illustrating a changing unit of the tension adjustment unit according to an exemplary embodiment of the present disclosure.

FIG. 1 is a view schematically illustrating a dishwasher according to an exemplary embodiment of the present disclosure. FIG. 2 is a perspective view schematically illustrating a hinge door and a tension adjustment unit of the dishwasher according to an exemplary embodiment of the present disclosure. FIG. 3 is a perspective view schematically illustrating the tension adjustment unit of the dishwasher according to an exemplary embodiment of the present disclosure. FIG. 4 is a view schematically illustrating a changing unit of the tension adjustment unit according to an exemplary embodiment of the present disclosure.

As illustrated in FIGS. 1 through 4, a dishwasher 1 may be installed into cabinetry 2 so as to offer a sense of monolithic beauty in a kitchen space.

The dishwasher 1 includes a housing 10, a door 11 and a cover 12. The housing 10 includes a bottom panel 10*b*, a top panel 10*d*, a rear panel 10*e* and both side panels 10*c* in order to form an external appearance of the dishwasher 1. The door 11 is configured to selectively open and close an opened front portion of the housing 10. The cover 12 is coupled to a front surface of the door 11 to offer a sense of monolithic beauty with cabinetry 2.

According to user's taste, ornaments or a doorknob 12*a* may be attached to the cover 12.

As the cover 12 is coupled to the front surface of the door 11, the weight of the door 11 changes according to a material and weight of the cover 12, and accordingly, a load of the spring 31 provided to restrict rotation of the door 11 should be adjusted.

A dishwashing tub (not shown) is provided inside the housing 10. A door hinge 20, which serves as a rotational axis of the door 11, is positioned at a lower end portion of the door 11 that opens and closes a front surface of the dishwashing tub and the housing 10. A spring 31 is connected to the door hinge 20 to adjust movement of the door 11. A tension adjustment unit 30 is provided to adjust tension of the spring 31.

The tension adjustment unit 30 is mounted to an inner lower portion of the housing 10. A tension adjustment hole 13, into which a rotation tool 14 to adjust tension of the spring 31 is inserted, is formed through a front panel 10*a* which extends upward from the bottom panel 10*b* of the housing 10.

The bottom panel 10*b* of the housing 10 may define a machine room (not shown) in which a sump (not shown) is provided below the dishwashing tub.

The tension adjustment unit 30 is provided at the bottom panel 10*b* of the housing 10. The spring 31 may be provided in a pair, both of which are arranged in a forward and backward direction (direction A) at both side portions of the bottom panel 10*b*.

Although it is described and illustrated in this embodiment that the tension adjustment hole 13 is formed at a lower portion of the front panel 10*a* of the housing 10, the embodiments of the present disclosure are not limited thereto. For example, the tension adjustment hole may be formed at a lower portion of the rear panel of the housing.

The door hinge 20 may be provided in a pair, both of which are respectively provided at both sides of a lower end portion of the door 11. Each door hinge 20 includes a hinge bracket 21 coupled to the side of the lower end portion of the door 11, a rope 32 having one end portion connected to the hinge bracket 21 and the other end portion connected to the spring 31, a support bracket 24 provided at the side panel 10*c* of the housing 10, and a guide roller 34 mounted to the support bracket 24 to guide movement of the rope 32.

The support bracket 24 is formed with a hinge protrusion 24*a* at a front portion of a lower end portion thereof. The hinge bracket 21 is formed with a hinge hole 21*a* corresponding to the hinge protrusion 24*a* of the support bracket 24. The hinge protrusion 24*a* is hinged to the hinge hole 21*a*. Accordingly, the door 11 rotates about a hinge shaft configured with the hinge protrusion 24*a* and the hinge hole 21*a* when the door opens and closes the housing 10.

The hinge bracket 21 is formed with a hinge connection part 22 at a lower end portion thereof. The hinge connection part 22 is formed in a hook shape to which the rope 32 is connected. The rope 32 may be provided with a first connection part 32*a* at one end portion thereof for connection with the hinge connection part 22 and a second connection part 32*b* at the other end portion thereof for connection with the spring 31.

The spring 31 includes a first spring 31*a* connected to the door hinge 20 mounted to one side of the door 11 and a second spring 31*b* connected to the door hinge 20 mounted to the other side of the door 11.

The tension adjustment unit 30 includes a connection member (hereinafter, wire 33) to connect the first spring 31*a* and the second spring 31*b*, and a changing unit 40 to change a length of the wire 33 so as to simultaneously adjust tension of the first and second springs 31*a* and 31*b*.

Although it is described and illustrated in this embodiment that the connection member connecting the first spring 31*a* and the second spring 31*b* is a wire, the embodiments of the present disclosure are not limited thereto. For example, the connection member may include a rope or the like.

The changing unit 40 includes a shaft 41, a first rotation member 44 rotatably connected to the shaft 41, and a second rotation member 45 engaged with the first rotation member 44 and configured to rotate to change the length of the wire 33.

One end portion of the shaft 41 is provided with a rotation support part 42 having a rotation support recess 42*a*, and the other end portion of the shaft 41 is connected to the first rotation member 44.

The rotation support recess 42*a* may have any one of a cross shape, a straight shape and a hexagonal shape, however, the present disclosure is not limited thereto.

The rotation tool 14 may include a head 14*a* which has any one of a cross shape, a straight shape and a hexagonal shape corresponding to the shape of the rotation support recess 42*a*, however, the present disclosure is not limited thereto. That is, while the shape of the rotation tool 14 corresponds to the shape of the rotation support recess 42*a*, however, these shapes may be shapes other than a cross shape, a straight shape, and a hexagonal shape.

The shaft 41 is positioned such that the rotation support part 42 corresponds to the tension adjustment hole 13 of the housing 10. The shaft 41 has a length corresponding to the size of the housing 10 so that the other end portion of the shaft 41 is connected to the first rotation member 44. The length of the shaft 41 may be changed to suit the size of the housing 10.

The first rotation member 44 is rotatably connected to the shaft 41, and is formed with a worm 44*a* on an outer peripheral surface thereof.

The second rotation member 45 includes a cylindrical-shaped body 45*a*, a gear part 45*b* formed at an end portion of the body 45*a* corresponding to the worm 44*a* of the first rotation member 44, and a wire fixing part 46 formed on an outer peripheral surface of the body 45*a*.

The gear part 45*b* may include a helical gear, however, the present disclosure is not limited thereto.

The wire fixing part 46 includes a wire insertion recess 46*a* into which the wire 33 is inserted to be connected thereto.

The wire insertion recess 46*a* may be formed concavely at the other end portion of the body 45*a*. The wire insertion recess 46*a* has a cross shape in this example embodiment, however, embodiments are not limited thereto. For example, the wire insertion recess 46*a* may have a straight shape so that the wire is fixedly inserted thereinto.

Therefore, the wire 33 inserted into the wire insertion recess 46*a* of the second rotation member 45 is wound on the outer peripheral surface of the body 45*a* of the second rotation member 45 by rotation of the shaft 41 and the first rotation member 44. Accordingly, the length of the wire 33 is changed, and therefore, tension of the first spring 31*a* and the second spring 31*b* connected to both end portions of the wire 33 is adjusted at the same time, thereby facilitating adjustment of left and right balance of the springs.

A wire guide roller 35 may be mounted to an inner surface of the bottom panel 10*b* of the housing 10 in order to guide movement of the wire 33. In this embodiment, the wire guide roller 35 is provided in a pair, both of which are respectively disposed at a rear left side and a rear right side of the bottom panel 10*b* of the housing 10, however, embodiments are not limited thereto. For example, the wire guide rollers may be arranged to suit the size of the housing.

Operation of the tension adjustment unit 30 of the dishwasher 1 constituted as above is as follows: if the rotation tool 14 is inserted into the tension adjustment hole 13 formed at the lower portion of the front panel 10*a* of the housing 10 and is rotated, the shaft 41 and the first rotation member 44 rotate and the second rotation member 45 also rotates by the gear part 45*b* having the helical gear corresponding to the worm 44*a* of the first rotation member 44. Accordingly, the length of the wire 33 is changed, and tension of the first spring 31*a* and the second spring 31*b* connected to the wire 33 is adjusted at the same time. As a result, left and right balance of the door 11 is adjusted.

As described above, since a user or a service technician adjusts tension of both springs 31 at the same time by inserting the rotation tool 14 into the tension adjustment hole 13 of the housing 10 and rotating the shaft 41 according to the varying load of the door 11 without disassembling the product, the adjustment of left and right balance of the door 11 may be accurately and easily achieved.

Figure 5:
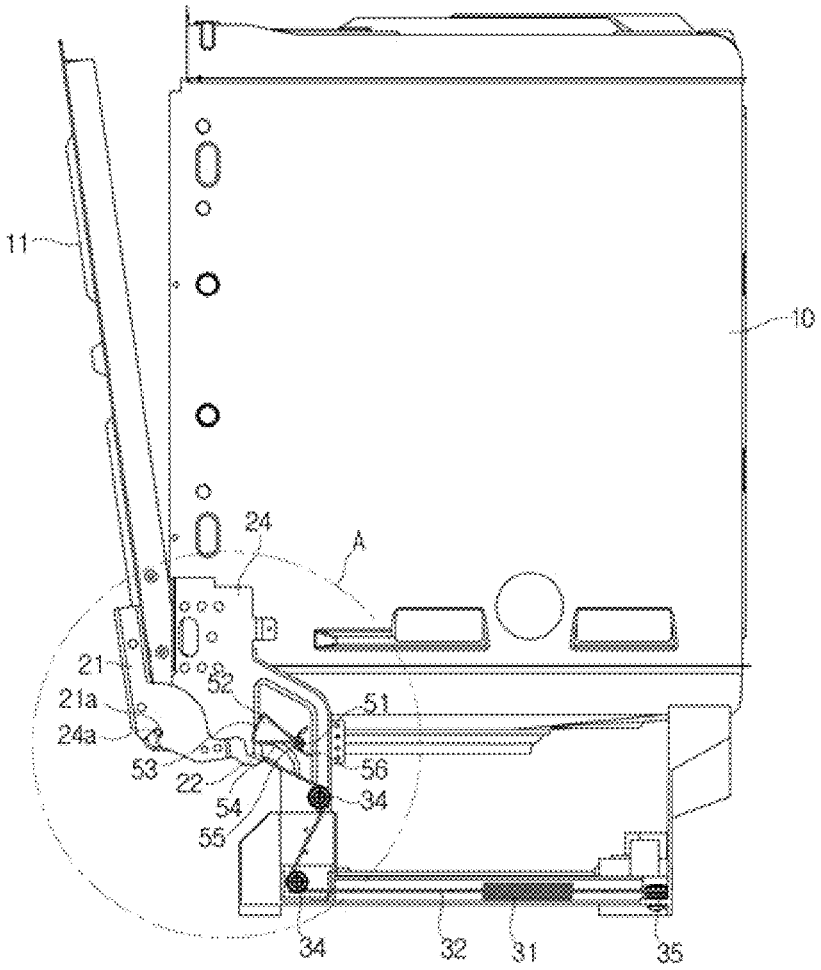
FIG. 5 is a view schematically illustrating a stopper unit according to an exemplary embodiment of the present disclosure.
Figure 6:
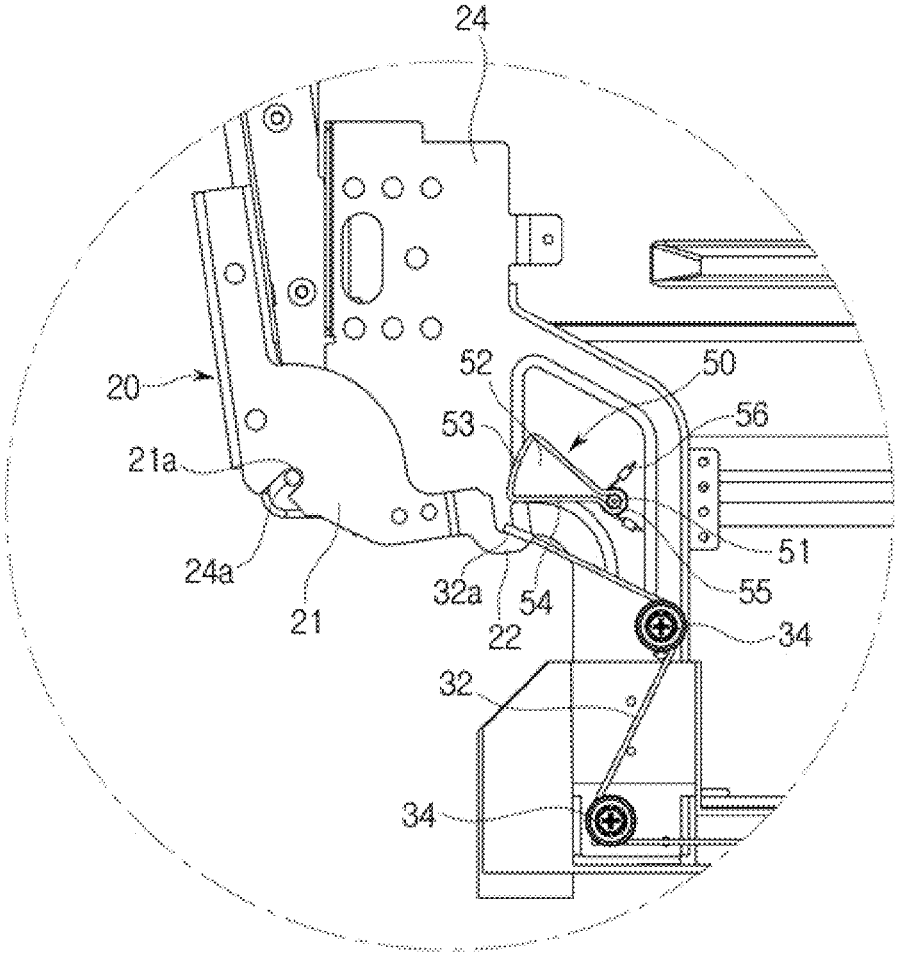
FIG. 6 is an enlarged view of a portion A depicted in FIG. 5.
Figure 7:
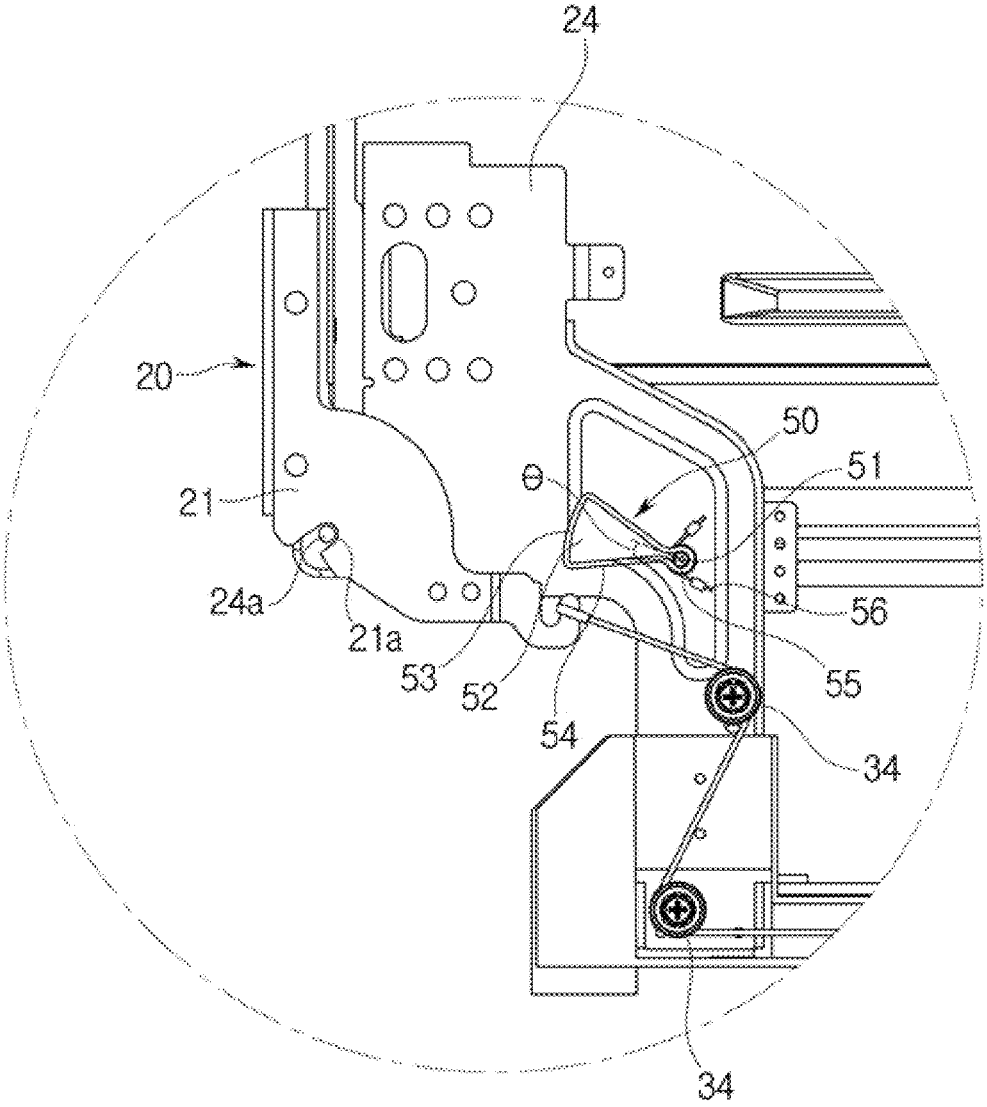
FIGS. 7 through 10 are views schematically illustrating a state of the stopper unit according to an exemplary embodiment of the present disclosure when a door is opened and closed.
Figure 8:
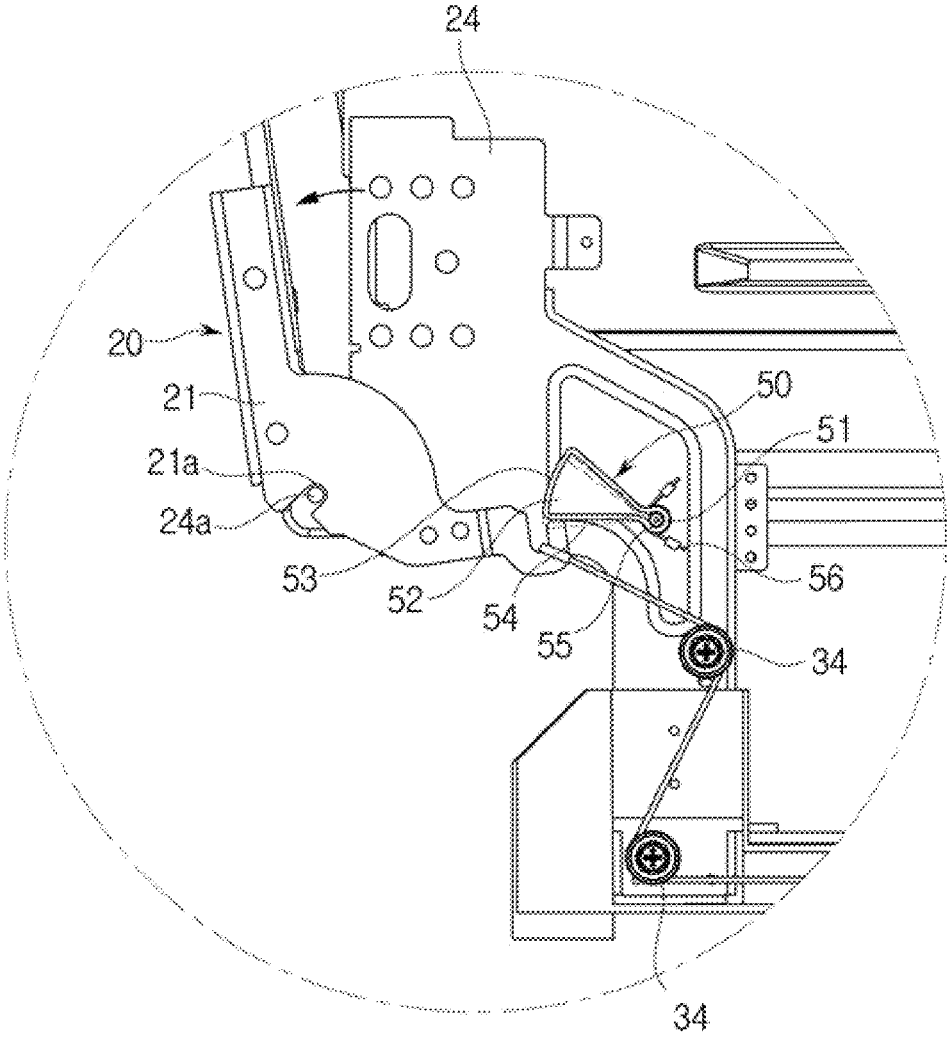
Figure 9:
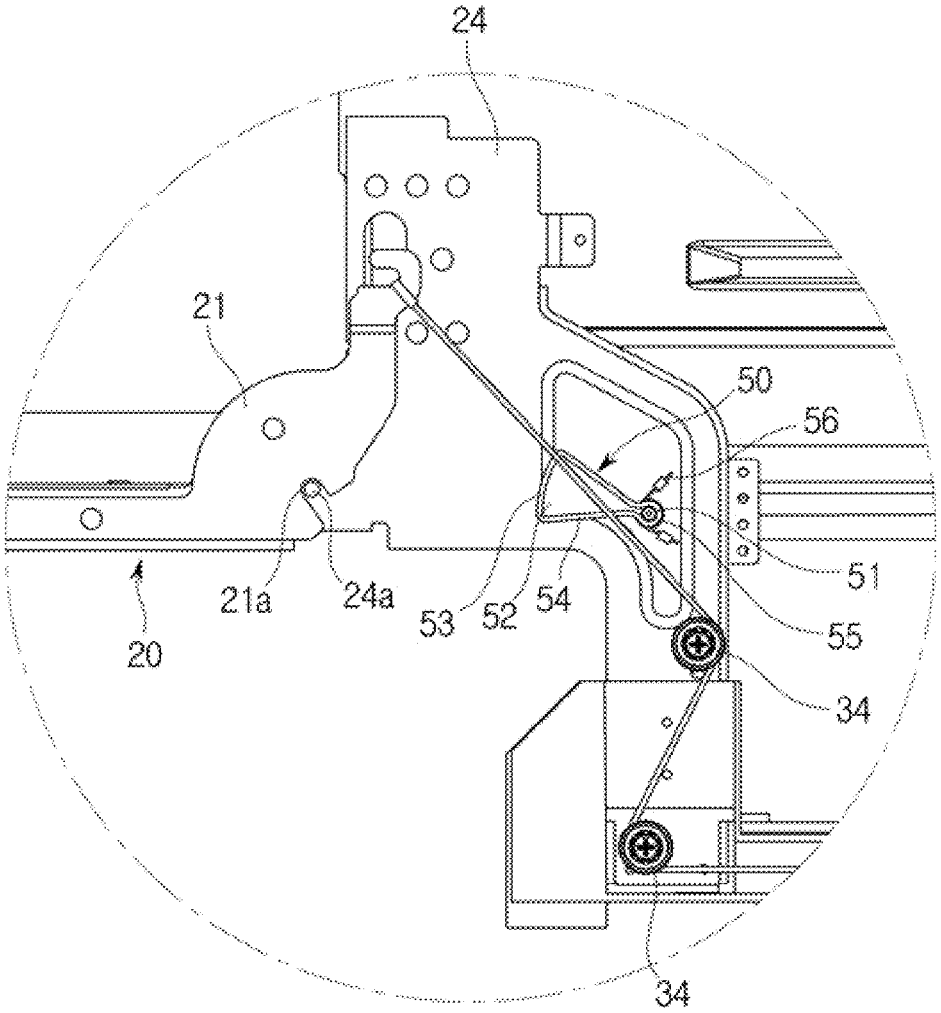
Figure 10:
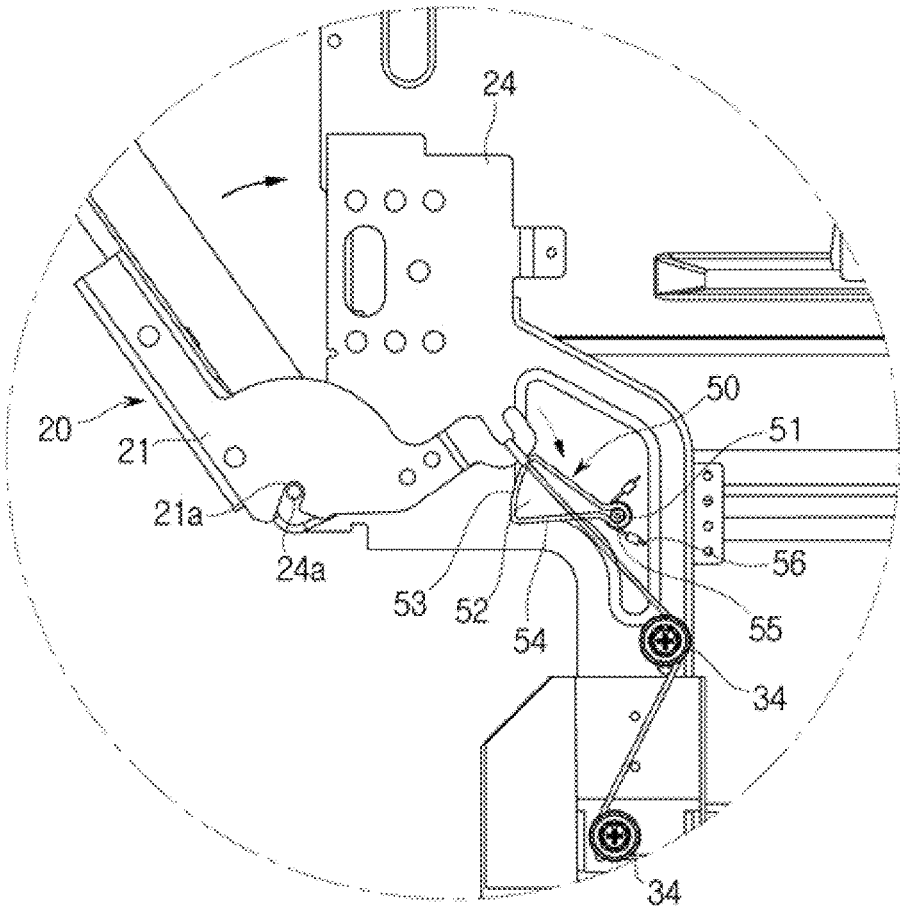

FIG. 5 is a view schematically illustrating a stopper unit according to an exemplary embodiment of the present disclosure, and FIG. 6 is an enlarged view of a portion A depicted in FIG. 5.

As illustrated in FIGS. 5 and 6, the door 11 provided at the front portion of the housing 10 to open and close the same may further include a stopper unit 50 by which the door 11 is kept opened at a constant angle.

The stopper unit 50 may be mounted to the support bracket 24 which is provided at the side panel of the housing 10. The guide roller 34 of the door hinge 20 is mounted to the support bracket 24.

The stopper unit 50 includes a stopper body 52 to restrict rotation of the hinge bracket 21 of the door hinge 20, and an elastic part 56 to apply elastic force to the stopper body 52.

The stopper body 52 includes a rotation part 55 configured with a rotation shaft 51, and a rotation support part 54 configured to contact the hinge bracket 21 to restrict rotation of the door hinge 20.

The rotation support part 54 defines a top surface and a bottom surface of the stopper body 52 and contacts the hinge connection part 22 of the hinge bracket 21, thereby restricting rotation of the hinge bracket 21 and the door 11.

A front surface 53 of the rotation support part 54 is formed in an arc shape which protrudes forward. The rotation support part 54 may include a torsion spring so as to return to the original state by elasticity when the door 11 is opened and closed.

FIGS. 7 through 10 are views schematically illustrating a state of the stopper unit according to an exemplary embodiment of the present disclosure when the door is opened and closed.

As illustrated in FIGS. 7 through 10, when the door 11 of the dishwasher 1 is in a closed state, the door hinge 20 is not in contact with the stopper unit 50.

In the state wherein the door 11 is closed, the stopper body 52 of the stopper unit 50 is in an upwardly slanted state at a predetermined angle θ from the horizontal plane.

While the door 11 is being opened, the hinge bracket 21 of the door 11 moves and the hinge connection part 22 formed at the lower end portion of the hinge bracket 21 comes into contact with the rotation support part 54 formed at the bottom surface of the stopper body 52 of the stopper unit 50.

The opening operation of the door 11 is temporarily stopped by contact of the hinge connection unit 22 and the rotation support part 54 of the stopper body 52, and therefore, the door 11 is kept opened at a constant angle.

If the opening operation of the door 11 is continued by a user, the hinge bracket 21 is separated from the stopper unit 50 and the door 11 is fully opened.

At this time, the stopper unit 50 returns to the original position by elastic force of the elastic part 56.

The opening operation of the door 11 may be smoothly achieved by tension of the spring 31 and the rope 32 connected to the hinge bracket 21.

While the door 11 is being closed, the hinge connection part 22 of the hinge bracket 21 smoothly moves by being guided by the arc-shaped front surface 53 of the stopper body 52 of the stopper unit 50.

The arc-shaped front surface 53 has a curved surface, a center portion of which protrudes to the front of the stopper body 52. The lower end portion of the hinge connection part 22 rotating while the door 11 is being closed moves from up to down while closely contacting the arc-shaped front surface 53, thereby enhancing comfort in use.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A dishwasher comprising:

a housing;

a door rotatably mounted to a front surface of the housing;

door hinges mounted to both sides of a lower portion of the door and rotatably coupled to the housing;

springs connected to the door hinges at both side portions inside the housing in order to adjust movement of the door;

a single connection member to connect the springs;

a shaft configured to rotate and having one end portion which is exposed outside the housing;

a first rotation member connected to the other end portion of the shaft; and a second rotation member engaged with the first rotation member and connected to the connection member, wherein tension of the springs is simultaneously adjusted by changing a length of the connection member by rotation of the shaft, each of the door hinges includes a hinge bracket coupled to the lower portion of the door, a rope having one end portion connected to the hinge bracket and the other end portion connected to each of the springs and a support bracket provided at the housing, the support bracket includes a stopper unit configured to contact the hinge bracket, thereby keeping the door opened at a constant angle, the stopper unit includes a stopper body to restrict rotation of the hinge bracket of the door hinge and an elastic part to apply elastic force to the stopper body, the stopper body includes a rotation part configured with a rotation shaft, a rotation support part configured to contact the hinge bracket to restrict rotation of the door hinge while the door is being opened, and a front surface of the rotation support part is formed in an arc shape which protrudes forward, whereby when the door is closed, the hinge connection part of the hinge bracket moves by contacting and being guided by the arc-shaped front surface of the stopper body.

2. The dishwasher of claim 1, wherein the springs are arranged in a forward and backward direction at both side portions inside the housing, the connection member is a wire, and the first rotation member is formed with a worm on an outer peripheral surface thereof.

3. The dishwasher of claim 2, wherein the second rotation member includes a body, a gear part formed at an end portion of the body to be engaged with the worm, and a wire fixing part formed on an outer peripheral surface of the body, on which the wire is wound.

4. The dishwasher of claim 3, wherein the gear part includes a helical gear.

5. The dishwasher of claim 3, wherein the wire fixing part includes a wire insertion recess into which the wire is inserted to be connected thereto.

6. The dishwasher of claim 5, wherein the wire insertion recess includes any one of a cross-shaped recess and a straight-shaped recess formed at a portion of the body.

7. The dishwasher of claim 1, wherein the housing is formed with a tension adjustment hole through which external force is applied to the shaft to rotate the same.

8. The dishwasher of claim 7, wherein the tension adjustment hole is formed at a lower portion of any one of a front panel and a rear panel of the housing.

9. The dishwasher of claim 7, wherein the shaft is provided with a rotation support part at an end portion thereof, the rotation support part having a rotation support recess to which a rotation tool is coupled through the tension adjustment hole.

10. The dishwasher of claim 1, wherein each of the door hinges further includes a guide roller mounted to the support bracket to guide movement of the rope.

11. The dishwasher of claim 1, wherein the housing includes one or more wire guide rollers to guide movement of the connection member.

12. A dishwasher comprising:

a door rotatably mounted to a front surface of a housing;

door hinges mounted to both sides of a lower portion of the door;

a first spring connected to one of the door hinges in order to adjust rotation of the door;

a second spring connected to the other of the door hinges in order to adjust rotation of the door;

a single connection member to connect the first spring and the second spring;

a shaft to adjust elastic force of the first spring and the second spring by changing a length of the connection member, the shaft being configured to rotate and having one end portion which is exposed outside the housing;

a first rotation member connected to the other end portion of the shaft; and a second rotation member including a helical gear engaged with the first rotation member to rotate therewith and a wire fixing part on which the connection member is wound to be connected thereto, each of the door hinges includes a hinge bracket coupled to the lower portion of the door, a rope having one end portion connected to the hinge bracket and the other end portion connected to each of the springs and a support bracket provided at the housing, the support bracket includes a stopper unit configured to contact the hinge bracket, thereby keeping the door opened at a constant angle, the stopper unit includes a stopper body to restrict rotation of the hinge bracket of the door hinge and an elastic part to apply elastic force to the stopper body, the stopper body includes a rotation part configured with a rotation shaft, a rotation support part configured to contact the hinge bracket to restrict rotation of the door hinge while the door is being opened, and a front surface of the rotation support part is formed in an arc shape which protrudes forward, whereby when the door is closed, the hinge connection part of the hinge bracket moves by contacting and being guided by the arc-shaped front surface of the stopper body.

13. The dishwasher of claim 12, wherein the first spring is arranged in a width direction at one side portion of the housing and the second spring is arranged at the other side portion of the housing, the first rotation member is formed with a worm on an outer peripheral surface thereof, and the second rotation member including the helical gear is engaged with the worm.

14. The dishwasher of claim 12, wherein the wire fixing part includes a wire insertion recess into which the connection member is inserted to be connected thereto.

15. The dishwasher of claim 13, wherein the housing is formed with a tension adjustment hole through which external force is applied to the shaft to rotate the same.

16. The dishwasher of claim 15, wherein the tension adjustment hole is formed at a lower portion of any one of a front panel and a rear panel of the housing.

17. The dishwasher of claim 12, wherein each of the door hinges further includes guide roller mounted to the support bracket to guide movement of the rope.

18. The dishwasher of claim 12, wherein the housing includes one or more wire guide rollers to guide movement of the connection member.

* * * * *